US008121777B2

(12) United States Patent
Guerrero et al.

(10) Patent No.: US 8,121,777 B2
(45) Date of Patent: Feb. 21, 2012

(54) WIRELESS BROADCASTING OF DRIVE-TIMES DATA

(75) Inventors: Miguel Guerrero, Sammamish, WA (US); Cosmin Corbea, Kirkland, WA (US)

(73) Assignee: Microsoft Corporation, Redmond, WA (US)

( * ) Notice: Subject to any disclaimer, the term of this patent is extended or adjusted under 35 U.S.C. 154(b) by 1020 days.

(21) Appl. No.: 12/043,955

(22) Filed: Mar. 7, 2008

(65) Prior Publication Data

US 2009/0228193 A1 Sep. 10, 2009

(51) Int. Cl.
*G08G 1/00* (2006.01)

(52) U.S. Cl. ..... 701/118

(58) Field of Classification Search ..... 701/118, 701/117, 119; 340/901, 905
See application file for complete search history.

(56) References Cited

U.S. PATENT DOCUMENTS

| | | | | |
|---|---|---|---|---|
| 5,845,227 | A | 12/1998 | Peterson | |
| 6,421,606 | B1 | 7/2002 | Asai et al. | |
| 6,765,998 | B2 | 7/2004 | Bruce et al. | |
| 6,915,204 | B1 | 7/2005 | Heideman | |
| 6,941,223 | B2 | 9/2005 | Schuessler | |
| 6,983,204 | B2 | 1/2006 | Knutson | |
| 7,050,903 | B1 * | 5/2006 | Shutter et al. | 701/117 |
| 7,069,143 | B2 * | 6/2006 | Peterson | 701/117 |
| 7,098,805 | B2 | 8/2006 | Meadows et al. | |
| 7,103,470 | B2 | 9/2006 | Mintz | |
| 7,221,287 | B2 | 5/2007 | Gueziec et al. | |
| 7,289,904 | B2 | 10/2007 | Uyeki | |
| 7,894,981 | B2 * | 2/2011 | Yamane et al. | 701/118 |

OTHER PUBLICATIONS

Kellerer; et al., "IP based enhanced Data Casting Services over Radio Broadcast Networks", Universal Multiservice Networks, 2000. ECUMN 2000. 1st European Conference on vol. , Issue , 2000 pp. 195-203.

Catling; et al., "Road Transport Informatics in Europe—Major Programs and Demonstrations", IEEE Transactions on Vehicular Technology, vol. 40, No. 1, Feb. 1991, pp. 132-140.

"Traffic Reports", http://www.msndirect.com/NavigationTrafficDetails680.aspx.

* cited by examiner

*Primary Examiner* — Mark Beauchaine
(74) *Attorney, Agent, or Firm* — Lyon & Harr, LLP; Richard T. Lyon

(57) ABSTRACT

Either vehicle traffic or financial markets data is regularly broadcast in a fixed size packet over a wireless network in a push manner to one or more wireless receiver devices located within a particular service coverage region. A data center stores information specific to the particular region including drive-times strings metadata, drive-times data, drive-times route metadata, traffic incident data and financial markets indicators data. The data center decides upon a particular type of information to be placed into a payload of a next packet to be broadcast and pre-formats this information accordingly without receiving any information from the receiver devices. Data structures are provided which contain data representing the drive-times strings metadata, drive-times data, drive-times route metadata, traffic incident data and financial markets indicators data.

14 Claims, 9 Drawing Sheets

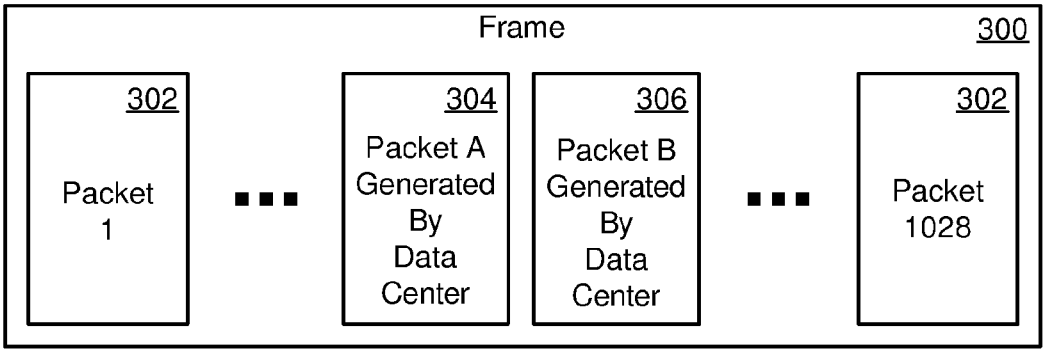
FIG. 3
| | Field | Byte Offset | Byte Size |
|---|---|---|---|
| 400 | CRC32 | 0 | 4 |
| 401 | Network ID | 4 | 1 |
| 402 | Time Adjust | 5 | 1 |
| 403 | Frame Time | 6 | 8 |
| 404 | Payload Type | 14 | 1 |
| 405 | Payload | 15 | 113 |
FIG. 4
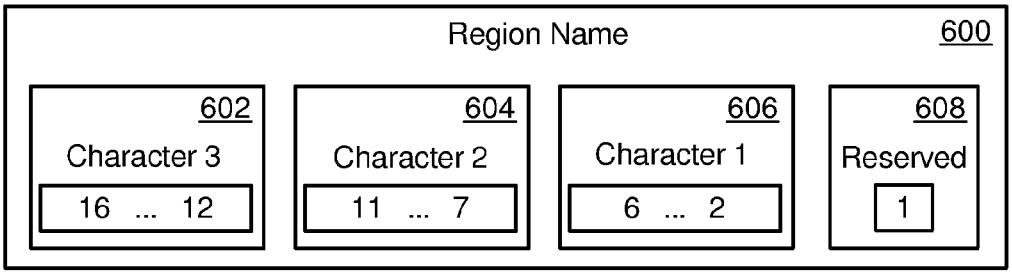
FIG. 6

| | Sub-Field | Byte Offset | Byte Size |
|---|---|---|---|
| 800 | Region ID | 0 | 1 |
| 801 | Metadata Version | 1 | 1 |
| 802 | Packet Number | 2 | 1 |
| 803 | Total Packets | 3 | 1 |
| 804 | Route String-Record Metadata | 4 | 109 |

| | Sub-Field | Byte Offset | Byte Size |
|---|---|---|---|
| 900 | String 1 ID | 0 | 1 |
| | String 1 Data | 1 | 15 |
| 901 | String 2 ID | 16 | 1 |
| | String 2 Data | 17 | 15 |
| ⋮ | ⋮ | | |
| 905 | String 6 ID | 80 | 1 |
| | String 6 Data | 81 | 15 |

908

910

| | Sub-Field | Byte Offset | Byte Size |
|---|---|---|---|
| 1000 | Region ID | 0 | 1 |
| 1001 | Metadata Version | 1 | 1 |
| 1002 | Packet Number | 2 | 1 |
| 1003 | Total Packets | 3 | 1 |
| 1004 | Route Description Metadata | 4 | 109 |

FIG. 10

| | Sub-Field | Byte Offset | Byte Size |
|---|---|---|---|
| 1100 | Route 1 Drive-Time Record ID | 0 | 1 |
| | Route 1 Origin | 1 | 1 |
| | Route 1 Destination | 2 | 1 |
| | Route 1 Via | 3 | 1 |
| 1101 | Route 2 Drive-Time Record ID | 4 | 1 |
| | Route 2 Origin | 5 | 1 |
| | Route 2 Destination | 6 | 1 |
| | Route 2 Via | 7 | 1 |
| ⋮ | ⋮ | ⋮ | |
| | 1130 | | |
| 1126 | Route 27 Drive-Time Record ID | 104 | 1 |
| | Route 27 Origin | 105 | 1 |
| | Route 27 Destination | 106 | 1 |
| | Route 27 Via | 107 | 1 |

1136 1134 1132

FIG. 11

| | Sub-Field | Byte Offset | Byte Size |
|---|---|---|---|
| 1200 | Region ID | 0 | 1 |
| 1201 | Packet Number | 1 | 1 |
| 1202 | Drive-Time Records | 2 | 111 |

FIG. 12

| | Sub-Field | 1396 Sequence Position | Bit Offset | Bit Size |
|---|---|---|---|---|
| 1300 | Drive-Time 1 | 00 hex | 0 | 6 |
| | Traffic Volume 1 | 00 hex | 6 | 2 |
| | Trend 1 | 00 hex | 8 | 2 |
| 1301 | Drive-Time 2 | 01 hex | 10 | 6 |
| | Traffic Volume 2 | 01 hex | 16 | 2 |
| | Trend 2 | 01 hex | 18 | 2 |
| ⋮ | ⋮ | | ⋮ | |
| | 1390 | | | |
| 1387 | Drive-Time 88 | 57 hex | 878 | 6 |
| | Traffic Volume 88 | 57 hex | 884 | 2 |
| | Trend 88 | 57 hex | 886 | 2 |
| | 1394 | 1392 | | |

FIG. 13

| | Sub-Field | Byte Offset | Byte Size |
|---|---|---|---|
| 1400 | Incident Type | 0 | 1 |
| 1401 | Incident ID | 1 | 1 |
| 1402 | Incident Start Time | 2 | 3 |
| 1403 | Incident End Time | 5 | 3 |
| 1404 | Incident Description | 8 | 105 |

FIG. 14

| 1500 Incident | 1502 Value |
|---|---|
| Congestion | 1 |
| Accident | 2 |
| Disabled Vehicle | 3 |
| Planned Event | 4 |
| Road Hazard | 5 |
| Miscellaneous | 6 |
| Basketball Game | 7 |
| Baseball Game | 8 |
| Football Game | 9 |
| Soccer Game | 10 |
| Hockey Game | 11 |
| Generic Sports Event | 12 |

FIG. 15

| | Sub-Field | Byte Offset | Byte Size |
|---|---|---|---|
| 1600 | Financial Markets Status | 0 | 1 |
| 1601 | Financial Markets Indicators Records | 1 | 112 |

FIG. 16

| | Sub-Field | Byte Offset | Byte Size |
|---|---|---|---|
| 1700 | Market Index 1 Name | 0 | 4 |
| | Price 1 | 4 | 8 |
| | Change 1 | 12 | 4 |
| | High 1 | 16 | 4 |
| | Low 1 | 20 | 4 |
| ⋮ | ⋮ | ⋮ | |
| | Market Index 4 Name (1704) | 72 | 4 |
| | Price 4 | 76 | 8 |
| 1703 | Change 4 | 84 | 4 |
| | High 4 | 88 | 4 |
| | Low 4 | 92 | 4 |

1712 1710 1708 1706

FIG. 17

WIRELESS BROADCASTING OF DRIVE-TIMES DATA

BACKGROUND

People find themselves facing an ever increasing pace of life along with an ever present demand to improve their productivity. People also find themselves living in an increasingly mobile society. For example, people are spending more time in their vehicles, either commuting to and from work, traveling between different work locations, traveling to client business meetings, or traveling for personal and family reasons. As a result, traffic congestion on the roadways is an ever increasing problem, particularly in major metropolitan regions. For people that routinely drive in a major metropolitan region, traffic congestion presents a significant obstacle to their productivity and quality of life.

SUMMARY

This Summary is provided to introduce a selection of concepts, in a simplified form, that are further described hereafter in the Detailed Description. This Summary is not intended to identify key features or essential features of the claimed subject matter, nor is it intended to be used as an aid in determining the scope of the claimed subject matter.

Data broadcasting technique embodiments described herein are generally applicable to broadcasting vehicle traffic information and financial markets information. In one embodiment, a first data structure is provided which contains data representing a particular type of vehicle traffic information, where this traffic information may include either drive-times strings metadata, drive-times data, drive-times route metadata, or traffic incident data. In another embodiment, a second data structure is provided which contains data representing a particular type of financial markets information, where this financial information may include financial markets indicators data. These first and second data structures have a fixed size.

In addition to the just described benefits, other advantages of the data broadcasting technique embodiments described herein will become apparent from the detailed description which follows hereafter.

DESCRIPTION OF THE DRAWINGS

The specific features, aspects, and advantages of the data broadcasting technique embodiments described herein will become better understood with regard to the following description, appended claims, and accompanying drawings where:

FIG. 3 illustrates a diagram of an exemplary embodiment, in simplified form, of a frame of data which is broadcast on a regular basis to each receiver device.

FIG. 4 illustrates a diagram of an exemplary embodiment of the format of two packets of data within the frame that are generated by the data center.

FIG. 6 illustrates a diagram of an exemplary embodiment of the format of a region name data field which may be contained in one of the two packets of data within the frame that are generated by the data center.

FIG. 10 illustrates a diagram of an exemplary embodiment of the format of a drive-times route metadata payload which may be contained in one or both of the two packets of data within the frame that are generated by the data center.

FIG. 11 illustrates a diagram of an exemplary embodiment of the format of a route description metadata sub-field which is contained in the drive-times route metadata payload.

FIG. 12 illustrates a diagram of an exemplary embodiment of the format of a drive-times data payload which may be contained in one or both of the two packets of data within the frame that are generated by the data center.

FIG. 13 illustrates a diagram of an exemplary embodiment of the format of a drive-time records data sub-field which is contained in the drive-times data payload.

FIG. 14 illustrates a diagram of an exemplary embodiment of the format of a traffic incident data payload which may be contained in one or both of the two packets of data within the frame that are generated by the data center.

FIG. 15 illustrates a diagram of an exemplary embodiment of a prescribed set of possible traffic incidents which may be specified within the traffic incident data payload.

FIG. 16 illustrates a diagram of an exemplary embodiment of the format of a financial markets indicators data payload which may be contained in one or both of the two packets of data within the frame that are generated by the data center.

FIG. 17 illustrates a diagram of an exemplary embodiment of the format of a financial markets indicators records data sub-field which is contained in the financial markets indicators data payload.

DETAILED DESCRIPTION

In the following description of data broadcasting technique embodiments reference is made to the accompanying drawings which form a part hereof, and in which are shown, by way of illustration, specific embodiments in which the technique may be practiced. It is understood that other embodiments may be utilized and structural changes may be made without departing from the scope of the technique embodiments.

1.0 General System Architecture for Wireless Broadcasting of Data

Figure 1:
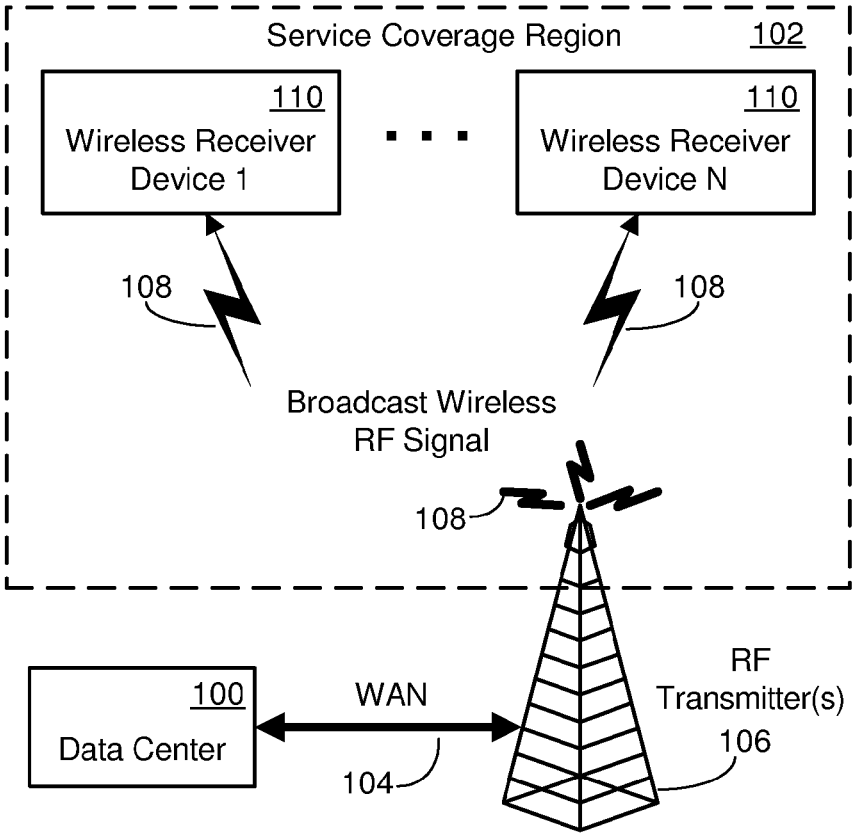
FIG. 1 illustrates a diagram of an exemplary embodiment, in simplified form, of a general architecture of a system for broadcasting various types of data from a data center to mobile wireless receiver devices.

FIG. 1 illustrates a diagram of an exemplary embodiment, in simplified form, of a general architecture of a system for broadcasting various types of data from a data center to mobile wireless receiver devices. The data being broadcast is managed and stored in the data center 100. The data center 100 may be organized and operate in either a centralized or network-distributed manner. In the case where the data center 100 is organized and operates in a network-distributed manner (not shown), the data in the data center would be stored in a distributed collection of different data servers (not shown) which are interconnected by either a LAN or WAN. In either case, the data to be broadcast is transmitted from the data center 100 over a WAN connection 104 to one or more RF transmitters 106. Each RF transmitter 106 encodes and serially broadcasts the data via a wireless (i.e. over the air) RF signal 108. As is understood by those skilled in the art, a plurality of RF transmitters 106, each transmitting the same RF signal 108, are commonly deployed in a major metropolitan region (not shown) both for fault tolerance reasons and to establish a service coverage region 102 that appropriately covers the metropolitan region.

Referring again to FIG. 1, each RF transmitter 106 serially broadcasts a frame of data (not shown), which is generated by the data center 100, every 113 seconds, 24 hours a day, 7 days a week. Each frame of data is broadcast in a "push" manner. In other words, each RF transmitter 106 only broadcasts the RF signal 108 (it never receives an RF signal) and each mobile wireless receiver device 110 only receives the RF signal 108 (it never transmits an RF signal). The RF signal 108 may be received by one or more receiver devices 110 when these devices are located within a particular service coverage region 102. The RF signal 108 may be broadcast over a variety of different wireless networks including, but not limited to, a variety of different direct broadcast networks such as FM radio and its related sub-carrier services. In tested embodiments the RF signal 108 is broadcast over a 67.647 kHz FM radio sub-carrier using a DirectBand™ (a trademark of Microsoft Corporation) wireless datacast network. The DirectBand™ network is currently available in most of the major metropolitan regions in North America. Other embodiments are also possible in which the RF signal 108 is broadcast over other FM sub-carrier frequency bands using other FM broadcasting methods.

FIG. 3 illustrates a diagram of an exemplary embodiment, in simplified form, of the frame of data which is broadcast on a regular basis as described heretofore via the wireless RF signal to each receiver device. The frame 300 is organized as 1028 individual packets 302 of data. Each packet 302 has a fixed total size of 128 bytes. As depicted in FIG. 3, and referring again to FIG. 1, two of the packets 304 and 306 in the frame 300 contain data generated by the data center 100. As will be described in more detail hereafter, the data in these two packets 304 and 306 is specific to the particular service coverage region 102 in which the frame 300 is broadcast.

FIG. 4 illustrates a diagram of an exemplary embodiment of the format of the two packets of data within the frame that are generated by the data center. As depicted in FIG. 4, and referring again to FIGS. 1 and 3, both of the 128-byte packets of data 304 and 306 in the frame 300 that are generated by the data center 100 contain six different fields of data 400-405 which are identified and formatted as follows. The data center 100 is responsible for appropriately pre-formatting the data in each field 400-405, and in any related sub-fields (not shown), and placing it therein. The first field 400 is a fixed four bytes in size and contains a 32-bit CRC value which is computed over the 124-byte remainder of the packet 304/306 (i.e. over the second through sixth fields 401-405). The second field 401 is a fixed one byte in size and contains an identification (ID) of the particular network that the packet 304/306 is being broadcast in. The third field 402 is a fixed one byte in size and contains data which is used by each receiver device 110 to accurately set its local time to an atomic-based time source which is accessible by the data center 100. This third field 402 is formatted as follows: the least significant five bits (bits 0-4) of this field specify the local time difference from the universal time code (UTC) time in hours, shifted by 12 hours; the next most significant bit (bit 5) of this field specifies whether or not to add an additional half-hour to accommodate particular geographic regions such as Newfoundland, among others; the next most significant bit (bit 6) of this field specifies whether or not to add an additional hour due to daylight savings time; the next most significant bit (bit 7) of this field is reserved. The fourth field 403 is a fixed eight bytes in size and contains data which specifies a UTC time stamp of the beginning of the current frame 300 in 100-nanosecond increments. The fifth field 404 is a fixed one byte in size and contains data which specifies the particular type of payload data that is contained in the sixth field 405. This sixth field 405 is a fixed 113 bytes in size and contains the payload data. Exemplary payload data types that may be accommodated are described hereafter.

Figure 5:
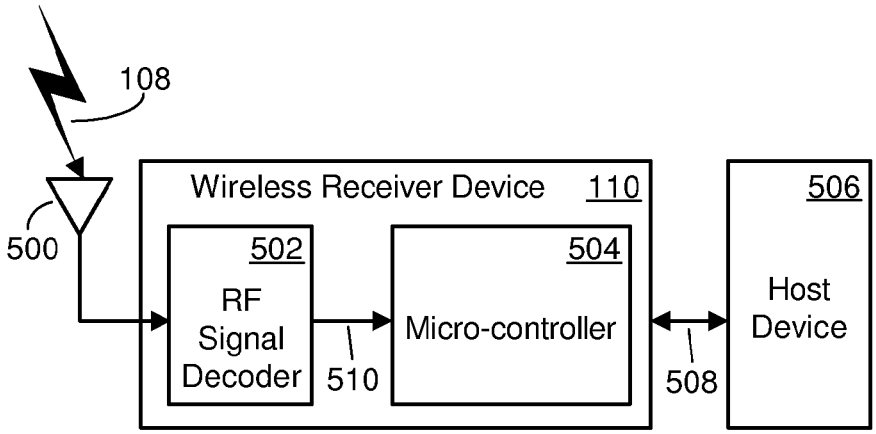
FIG. 5 illustrates a diagram of an exemplary embodiment, in simplified form, of a general architecture of each receiver device.

FIG. 5 illustrates a diagram of an exemplary embodiment, in simplified form, of a general architecture of each mobile wireless receiver device. As depicted in FIG. 5, and referring again to FIGS. 1 and 3, each receiver device 110 is a compact, self-contained, highly integrated, low power device. The receiver device 110 generally includes an antenna 500, an RF signal decoder 502 and a micro-controller 504. Upon initial power-up of the receiver device 110, the RF signal decoder 502 scans the entire FM spectrum and automatically tunes itself to the strongest FM frequency in the service coverage region 102 that is carrying the aforementioned DirectBand™ broadcast. The RF signal decoder 502 may also be prompted by a user of the receiver device 110 to search for another FM frequency carrying a DirectBand™ broadcast in order to find a more reliable RF signal 108, or to find a different broadcast containing data that better meets the user's needs at a particular point in time. As is understood by those skilled in the art, the size of any particular service coverage region 102 depends on a number of different factors such as the particular power of the signal 108 broadcast from each transmitter 106, the number of different transmitters employed in the region, and the particular design of the antenna 500 employed in each receiver device 110. In tested embodiments an antenna with 40 dB μV attenuation was used. It is noted that some major metropolitan regions span a large geographic area. Such a metropolitan region may encompass a plurality of different cities in a single region. For such a metropolitan region, a plurality of RF transmitters 106 may be employed to establish an appropriately sized service coverage region 102. A plurality of different DirectBand™ broadcasts may also be employed in such a metropolitan region, where each broadcast supplies information related to a specific city or sub-region within the overall region. It is also noted that each receiver device 110 may be mobile, such as the case where it is being used in a moving vehicle which is traveling the roadways in a service coverage region 102.

Referring again to FIGS. 1, 3 and 5, the antenna 500 receives the wireless RF signal 108 containing the frame 300 of data that is broadcast on a regular basis from each RF transmitter 106. The antenna 500 translates the received RF signal 108 into an electrical signal and inputs this electrical signal to the RF signal decoder 502. The RF signal decoder 502 decodes the electrical signal received from the antenna 500 in order to extract the serial data broadcast by the data center 100. The RF signal decoder 502 transmits the extracted data to the micro-controller 504 over a one-way interface 510, and the micro-controller caches the extracted data. Once the micro-controller 504 has received the current full frame 300 of data, it parses the frame to identify the aforementioned two packets of data 304 and 306 that were generated by the data center 100. The micro-controller 504 uses the 32-bit CRC data value in the first field 400 of these two packets 304 and 306 to verify that each packet was received without error. If a packet 304 or 306 is verified to have been received without error, the micro-controller 504 transmits the entire packet over a full-duplex serial interface 508 to a host device 506. If a packet 304 or 306 is found to have been received with errors, the micro-controller 504 discards the packet. In tested embodiments an RS-232 interface was used for this full-duplex interface 508. However, other suitable interfaces could also be used in place of RS-232. Since a new frame 300 of data is generated by the data center 100 and broadcast via the RF signal 108 every 113 seconds, 24 hours a day, 7 days a week (as described heretofore), the micro-controller 504 transmits two new packets of current data 304 and 306 to the host device 506 every 113 seconds as long as the receiver device 110 is located within the service coverage region 102 and is able to receive the RF signal 108.

Referring again to FIGS. 1, 3 and 4, the data center 100 generally stores, and transmits to each RF transmitter 106 for broadcast, a variety of different types 404 of payload data 405 for each particular service coverage region 102 that might be desirable or of interest to users of the receiver devices 110 when they are in the region. The different payload types 404 are generally organized into data categories (not shown), where each data category employs one or more payload types, and where the payload 405 for each payload type employs a plurality of data sub-fields (not shown). Exemplary data categories stored in the data center 100 include, but are not limited to, current and historic detailed weather data for the region 102, current and historic vehicle traffic data for the region, and current financial data for the region. These data categories, their payload type(s) 404, and the format of the data sub-fields employed in their respective payload(s) 405 are described in more detail hereafter.

Referring again to FIGS. 1, 3 and 4, for each frame 300 to be broadcast, the data center 100 is responsible for deciding which type(s) 404 of payload data 405 to place into the two packets 304 and 306 within the frame that are generated by the data center. The data center 100 makes this decision without receiving any information from the receiver devices 110. There are a number of advantages associated with the fact that a common, pre-determined set of payload data 405 is broadcast from the data center 100 to all the receiver devices 110 located within the service coverage region 102. By way of example but not limitation, the required design of each receiver device 110 is simplified, its cost and power consumption are reduced, and its operational reliability is improved since it only has to operate as a radio receiver that pushes data to the host device 506. Each receiver device 110 does not have to receive data from the host device 506 regarding which type of data is desired by the user at different points in time. Thus, each receiver device 110 does not have to operate as an RF transmitter to send these data requests to the data center 100.

1.1 Computing Environment

This section provides a brief, general description of a suitable computing system environment in which portions of the data broadcasting technique embodiments described herein may be implemented. The technique embodiments are operational with numerous general purpose or special purpose computing system environments or configurations. Exemplary well known computing systems, environments, and/or configurations that may be suitable include, but are not limited to, personal computers (PCs), server computers, handheld or laptop devices, multiprocessor systems, microprocessor-based systems, set top boxes, programmable consumer electronics, network PCs, minicomputers, mainframe computers, distributed computing environments that include any of the aforementioned systems or devices, and the like. The technique embodiments are also operational with a variety of intelligent vehicle audio devices and vehicle navigation devices which will be described in more detail hereafter.

Figure 2:
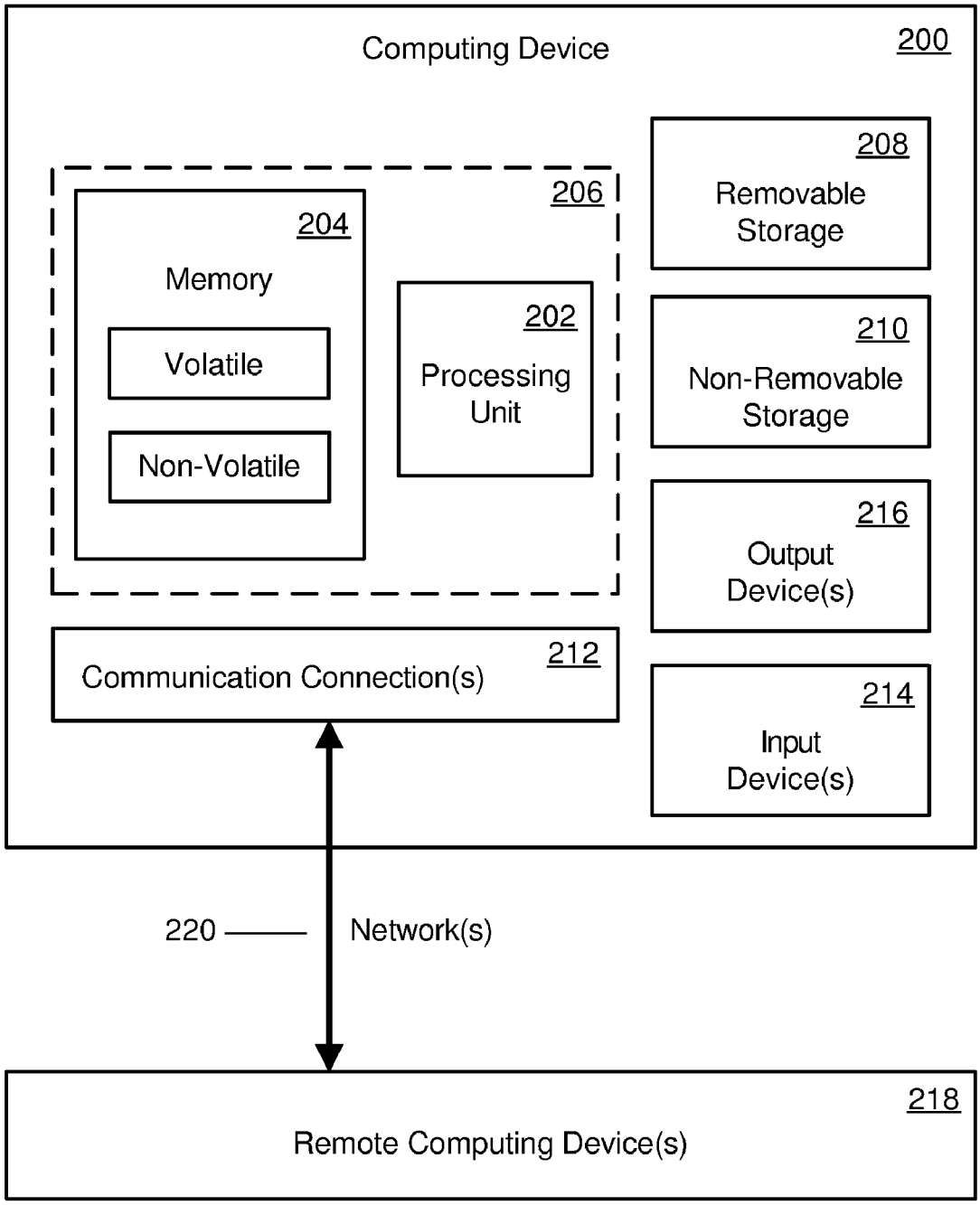
FIG. 2 illustrates a diagram of an exemplary embodiment, in simplified form, of general purpose, network-based computing devices which constitute an exemplary system for implementing the data broadcasting technique embodiments described herein.

FIG. 2 illustrates a diagram of an exemplary embodiment, in simplified form, of a suitable computing system environment according to the data broadcasting technique embodiments described herein. The environment illustrated in FIG. 2 is only one example of a suitable computing system environment and is not intended to suggest any limitation as to the scope of use or functionality of the technique embodiments described herein. Neither should the computing system environment be interpreted as having any dependency or requirement relating to any one or combination of components exemplified in FIG. 2.

As illustrated in FIG. 2, an exemplary system for implementing the technique embodiments described herein includes one or more computing devices, such as computing device 200. In its simplest configuration, computing device 200 typically includes at least one processing unit 202 and memory 204. Depending on the specific configuration and type of computing device, the memory 204 may be volatile (such as RAM), non-volatile (such as ROM and flash memory, among others) or some combination of the two. This simplest configuration is illustrated by dashed line 206.

As exemplified in FIG. 2, computing device 200 may also have additional features and functionality. By way of example, computing device 200 may include additional storage such as removable storage 208 and/or non-removable storage 210. This additional storage includes, but is not limited to, magnetic disks, optical disks and tape. Computer storage media typically embodies volatile and non-volatile media, as well as removable and non-removable media implemented in any method or technology. The computer storage media provides for storage of various information required to operate the device 200 such as computer readable instructions associated with an operating system, application programs and other program modules, and data structures, among other things. Memory 204, removable storage 208 and non-removable storage 210 are all examples of computer storage media. Computer storage media includes, but is not limited to, RAM, ROM, EEPROM, flash memory or other memory technology, CD-ROM, digital versatile disks (DVD) or other optical disk storage technology, magnetic cassettes, magnetic tape, magnetic disk storage or other magnetic storage devices, or any other medium which may be used to store the desired information and which may be accessed by computing device 200. Any such computer storage media may be part of computing device 200.

As exemplified in FIG. 2, computing device 200 also includes a communications connection(s) 212 that allows the device to operate in a networked environment and communicate with a remote computing device(s), such as remote computing device(s) 218. Remote computing device(s) 218 may be a PC, a server, a router, a peer device, other common network node, an intelligent vehicle audio device, or a vehicle navigation device, and typically includes many or all of the elements described herein relative to computing device 200. Communication between computing devices takes place over a network(s) 220, which provides a logical connection(s) between the computing devices. The logical connection(s) may include one or more different types of networks including, but not limited to, a local area network(s) (LAN) and wide area network(s) (WAN). Such networking environments are commonplace in conventional offices, enterprise-wide computer networks, intranets and the Internet. It will be appreciated that the communications connection(s) 212 and related network(s) 220 described herein are exemplary and other means of establishing communication between the computing devices may be used.

As exemplified in FIG. 2, communications connection(s) 212 and related network(s) 220 are an example of communication media. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, but not limitation, communication media includes wired media such as a wired network or direct-wired connection, and wireless media such as acoustic, radio frequency (RF), infrared, frequency modulation (FM) radio and other wireless media. The term "computer-readable medium" as used herein includes both the aforementioned storage media and communication media.

As exemplified in FIG. 2, computing device 200 also includes an input device(s) 214 and output device(s) 216. Exemplary input devices 214 include, but are not limited to, a keyboard, mouse, pen, touch input device, microphone, and camera, among others. A user may enter commands and various types of information into the computing device 200 through the input device(s) 214. Exemplary output devices 216 include, but are not limited to, a display device(s), a printer, and audio output devices, among others. These input and output devices are well known and need not be described at length here.

The data broadcasting technique embodiments described herein may be further described in the general context of computer-executable instructions, such as program modules, which are executed by computing device 200. Generally, program modules include routines, programs, objects, components, and data structures, among other things, that perform particular tasks or implement particular abstract data types. The technique embodiments may also be practiced in a distributed computing environment where tasks are performed by one or more remote computing devices 218 that are linked through a communications network 212/220. In a distributed computing environment, program modules may be located in both local and remote computer storage media including, but not limited to, memory 204 and storage devices 208/210.

Referring again to FIGS. 1 and 2, the data center 100 may be any one of the variety of different computing devices 200 described heretofore. In the aforementioned case where the data center 100 is organized and operates in a network-distributed manner, each of the aforementioned different data servers may be any one of these different computing devices 200.

Referring again to FIGS. 1, 2, 3 and 5, the host device 506 may also be any one of the variety of different computing devices 200 described heretofore. The host device 506 may either be integrated together with the receiver device 110 in a common package, or the host device and receiver device may reside in two separate packages. In either case, as described heretofore, every 113 seconds the host device 506 receives two new data packets 304 and 306 from the receiver device 110 over the full-duplex interface 508. Based on commands which a user enters into the host device 506 via an input device 214 on the host device, it decides whether or not, and how to, process the data contained in the data packets 304 and 306. Based on this processing, the host device 506 provides the data to the user in a useable format via an output device 216. In one embodiment of the data broadcasting technique, the output device 216 may be a display device (not shown), which is either integrated into, or attached to, the host device 506, and which displays the data in an appropriate format to the user. In another embodiment, the output device 216 may be an audio output device (not shown), such as a loudspeaker (s) or headphones, which audibly dictates the data to the user via an appropriate synthesized voice. Exemplary host devices 506 include portable hand-held computer devices, computer-based car stereo devices, computer-based coffee makers, computer-based watches and the like.

1.2 General Data Broadcasting

Referring again to FIGS. 1 and 4, this section describes two particular general data fields which are employed within the aforementioned weather data category stored in the data center 100 and broadcast to each receiver device 110 in the service coverage region 102. The weather data category may employ a plurality of different types of payloads 404/405. In tested embodiments the weather data category employed the following two types of payloads 404/405: general weather data and local weather data. The general weather data payload 404/405 employs a number of different data fields, two of which contain general data for the region 102. These two general data fields will now be described. As described heretofore, the data center 100 is responsible for appropriately pre-formatting the data and placing it into each data field and any related sub-fields.

FIG. 6 illustrates a diagram of an exemplary embodiment of the format of a region name data field which is employed within the general weather data payload. As depicted in FIG. 6, and referring again to FIGS. 1 and 4, the region name data field 600 is employed within the payload 405 of the general weather data payload type 404. This data field 600 is a fixed 16 bits in size and contains a five bit per character, three character code that uniquely, geographically specifies the particular service coverage region 102 in which the broadcast is taking place. The least significant bit 608 of this data field 600 is reserved. The next most significant five bits of this data field 600 specify the first character 606 of the region name code, the next most significant five bits specify the second character 604 of the region name code, and the most significant five bits specify the third character 602 of the region name code. In tested embodiments over 100 different geographic regions within North America were supported. Additional geographic regions are planned to be added in future embodiments.

Figures 7, 8, 9:
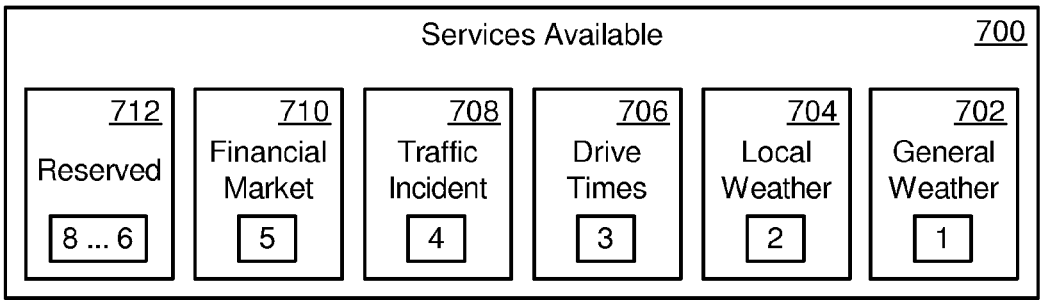
FIG. 7 illustrates a diagram of an exemplary embodiment of the format of a services available data field which may also be contained in the same packet of data as the region name data field.
FIG. 8 illustrates a diagram of an exemplary embodiment of the format of a drive-times strings metadata payload which may be contained in one or both of the two packets of data within the frame that are generated by the data center.
FIG. 9 illustrates a diagram of an exemplary embodiment of the format of a route string-record metadata sub-field which is contained in the drive-times strings metadata payload.

FIG. 7 illustrates a diagram of an exemplary embodiment of the format of a services available data field which is also employed within the general weather data payload. As depicted in FIG. 7, and referring again to FIGS. 1 and 4, the services available data field 700 is also employed within the payload 405 of the general weather data payload type 404. This data field 700 is a fixed eight bits in size. The least significant bit 702 of this data field 700 specifies whether or not general weather data is available for the particular service coverage region 102 in which the broadcast is taking place. The next most significant bit 704 specifies whether or not local weather data is available for the region 102. The next most significant bit 706 specifies whether or not drive-times data is available for the region 102. The next most significant bit 708 specifies whether or not traffic incident data is available for the region 102. The next most significant bit 710 specifies whether or not financial data is available for the region 102. The most significant three bits 712 of this data field 700 are reserved. By way of example but not limitation, a binary value of 00010111 broadcast for this data field 700 in a particular region 102 specifies that general weather, local weather, drive-times and financial data are available for the region, but that traffic incident data is not available.

1.3 Drive-Times Data Broadcasting

Referring again to FIGS. 1 and 4, this section describes the aforementioned vehicle traffic data category which is stored in the data center 100 and broadcast to each receiver device 110 in the service coverage region 102. The vehicle traffic data category may employ a plurality of different types of payloads 404/405. In tested embodiments the vehicle traffic data category employed the following four types of payloads 404/405: drive-times strings metadata, drive-times route metadata, drive-times data, and traffic incident data. Each of these four payload types 404 and the data sub-fields (not shown) employed within their respective payloads 405 will now be describe in more detail. As described heretofore, the data center 100 is responsible for appropriately pre-formatting the data and placing it into each data field and any related sub-fields.

1.3.1 Drive-Times Strings Metadata

FIG. 8 illustrates a diagram of an exemplary embodiment of the format of the drive-times strings metadata payload. As depicted in FIG. 8, and referring again to FIGS. 1 and 3-6, the drive-times strings metadata payload 405 is a fixed 113 bytes in total size and contains five different data sub-fields 800-804 which are identified and formatted as follows. The first sub-field 800 is a fixed one byte in size and contains a region ID value. A change in the value of the region ID 800 informs each receiver device 110 that the information in the route string-record metadata sub-field 804 corresponds to a different service coverage region 102 than the particular region which the receiver device is configured for based on the aforementioned region name data field 600 that was previously broadcast to the receiver device. In this case, since the information contained in the drive-times route metadata payload (which is described in detail hereafter) for the new region 102 might be different than that which was previously broadcast, each receiver device 110 would instruct the host device 506 to delete the previously broadcast route description metadata (which is also described in detail hereafter) from its storage. The second sub-field 801 is a fixed one byte in size and contains a metadata version value whose most significant two bits specifies a major version value (not shown) for the information in the route string-record metadata sub-field 804, and whose least significant six bits specifies a minor version value (not shown) for this information. If the minor version value is different from that which that was previously broadcast but the major version value is the same as that which was previously broadcast, this informs each receiver device 110 that the information in the route string-record metadata sub-field 804 specifies additional routes to those which were previously broadcast. If the major version value is different from that which that was previously broadcast, this informs each receiver device 110 that any previously broadcast route string-record metadata 804 information should be deleted from the host device's 506 storage. The third sub-field 802 is a fixed one byte in size and contains a packet number value which specifies a sequence number for the current packet 304 or 306. The fourth sub-field 803 is a fixed one byte in size and contains a total packets value which specifies a total number of packets 304/306 to be broadcast that will contain the latest route string-record metadata. The fifth sub-field 804 is a fixed 109 bytes in size and contains the route string-record metadata.

FIG. 9 illustrates a diagram of an exemplary embodiment of the format of the route string-record metadata sub-field. As depicted in FIG. 9, and referring again to FIG. 8, the route string-record metadata sub-field 804 contains 12 different sub-fields which are organized as six different pairs of sub-fields 900-905. Each of the six pairs of sub-fields 900-905 specifies a particular route string as follows. The first sub-field in each pair (e.g. 908) is a fixed one byte in size and specifies an ID for the particular route string. The second sub-field in each pair (e.g. 910) is a fixed 15 bytes in size and contains 20 different characters which specify a particular city, landmark or "via" using a six bit encoding per character. In this context, the term "via" herein refers to an actual route to be used (e.g. I-90-405-520). A value of FF hex in the first sub-field in a particular pair (e.g. 908) indicates that no additional records are contained in the route string-record metadata sub-field 804. A second sub-field in a particular pair (e.g. 910) which is populated with a value of 00 hex indicates an empty sub-field (i.e. no string data is in the sub-field).

1.3.2 Drive-Times Route Metadata

FIG. 10 illustrates a diagram of an exemplary embodiment of the format of the drive-times route metadata payload. As depicted in FIG. 10, and referring again to FIGS. 1 and 3-6, the drive-times route metadata payload 405 is a fixed 113 bytes in total size and contains five different data sub-fields 1000-1004 which are identified and formatted as follows. The first sub-field 1000 is a fixed one byte in size and contains a region ID value; a change in the value of region ID 1000 informs the receiver device 110 that the information in the route description metadata sub-field 1004 corresponds to a different service coverage region 102 than the particular region which the receiver device is configured for based on the aforementioned region name data field 600 that was previously broadcast to the receiver device. In this case, since the information contained in the drive-times route metadata payload 405 for the new region 102 might be different than that which was previously broadcast, each receiver device 110 would instruct the host device 506 to delete the previously broadcast route description metadata 1004 from its storage. The second sub-field 1001 is a fixed one byte in size and contains a metadata version value whose most significant two bits specifies a major version value (not shown) for the information in the route description metadata sub-field 1004, and whose least significant six bits specifies a minor version value (not shown) for this information. If the minor version value changes from that which that was previously received but the major version value does not change, this informs the receiver device 110 that the information in the route description metadata sub-field 1004 specifies additional routes to those which were previously received. If the major version value changes from that which that was previously received, this informs the receiver device 110 that any previously received route description metadata 1004 information should be deleted from the host device's 506 storage. The third sub-field 1002 is a fixed one byte in size and contains a packet number value which specifies a sequence number for the current packet 304 or 306. The fourth sub-field 1003 is a fixed one byte in size and contains a total packets value which specifies the total number of packets 304/306 to be broadcast that will contain the latest route description metadata. The fifth sub-field 1004 is a fixed 109 bytes in size and contains the route description metadata.

FIG. 11 illustrates a diagram of an exemplary embodiment of the format of the route description metadata sub-field. As depicted in FIG. 11, and referring again to FIG. 10, the route description metadata sub-field 1004 contains 108 different fields which are organized as 27 different sets of sub-fields

1100-1126. Each of the 27 sets of sub-fields 1100-1126 contains four different sub-fields which describe a particular route as follows. The first sub-field in each set (e.g. 1130) is route drive-time record sub-field which is a fixed one byte in size. The route drive-time record sub-field (e.g. 1130) identifies a particular drive-time record that is mapped to the particular route (e.g. 1126) by specifying a sequence position for the particular drive-time record within a drive-time records data sub-field which will be described hereafter. The second sub-field in each set (e.g. 1132) is a fixed one byte in size and contains a string-record which specifies an origin for the particular route. The third sub-field in each set (e.g. 1134) is a fixed one byte in size and contains a string-record which specifies a destination for the particular route. The fourth sub-field in each set (e.g. 1136) is a fixed one byte in size and contains a string-record which specifies a pathway for the particular route. A value of FF hex in the four sub-fields (e.g. 1130, 1132, 1134 and 1136) within a particular set of sub-fields (e.g. 1126) indicates that no additional records are contained in the route description metadata sub-field 1004.

1.3.3 Drive-Times Data

FIG. 12 illustrates a diagram of an exemplary embodiment of the format of the drive-times data payload. As depicted in FIG. 12, and referring again to FIGS. 1, 3-6 and 10, the drive-times data payload 405 is a fixed 113 bytes in total size and contains three different data sub-fields 1200-1202 which are identified and formatted as follows. The first sub-field 1200 is a fixed one byte in size and contains a region ID value; a change in the value of the region ID 1200 informs the receiver device 110 that the information in a drive-time records sub-field 1202 corresponds to a different service coverage region 102 than the particular region which the receiver device is configured for based on the aforementioned region name data field 600 that was previously broadcast to the receiver device. In this case, since the information contained in the drive-times route metadata payload 405 for the new region 102 might be different than that which was previously broadcast, each receiver device 110 would instruct the host device 506 to delete the previously broadcast route description metadata 1004 from its storage. The second sub-field 1201 is a fixed one byte in size and contains a packet number value. When the most significant bit (not shown) of the packet number 1201 is set to one, this indicates to each receiver device 110 that the current packet 304 or 306 is the first in a sequence of packets to be subsequently broadcast; in this case, the least significant seven bits (not shown) of the packet number specify the total number of packets in the sequence that will be broadcast, and hence how many packets in total the receiver should expect. When the most significant bit of the packet number 1201 is set to zero, the least significant seven bits specify a sequence number for the current packet 304 or 306. The third sub-field 1202 is a fixed 111 bytes in size and contains the drive-time records data.

FIG. 13 illustrates a diagram of an exemplary embodiment of the format of the drive-time records data sub-field. As depicted in FIG. 13, and referring again to FIGS. 11 and 12, the drive-time records data sub-field 1202 contains 264 different sub-fields which are organized as 88 different sets of sub-fields 1300-1387. Each of the 88 sets of sub-fields 1300-1387 contains three different sub-fields which describe a particular drive-time record as follows. As described heretofore, each drive-time record (e.g. 1387) is mapped to a particular route (e.g. 1126) by the value in the aforementioned route drive-time record ID sub-fields (e.g. 1130). More particularly, the value in the route drive-time record ID sub-field (e.g. 1130) for a particular route (e.g. 1126) specifies a sequence position 1396 for the particular drive-time record (e.g. 1387) within the drive-time records data sub-field 1202. The first sub-field in each set (e.g. 1390) is a fixed six bits in size and specifies a current drive-time for the particular route (e.g. 1126) the drive-time record (e.g. 1387) is mapped to. This six-bit sub-field (e.g. 1390) is encoded to specify the current drive-time as follows. A value of one decimal in this sub-field (e.g. 1390) specifies a drive-time of zero minutes, a value of two decimal specifies a drive-time of one minute, a value of three decimal specifies a drive-time of two minutes, and so on up to a value of 61 decimal which specifies a drive-time of 60 minutes. A value of 62 decimal in this sub-field (e.g. 1390) specifies a drive-time of more than 60 minutes. A value of zero in this sub-field (e.g. 1390) specifies that no drive-time information is available and a value of 63 decimal specifies that no additional drive-time records are available in the drive-time records data sub-field 1202 for the particular route. The second sub-field in each set (e.g. 1392) is a fixed two bits in size and specifies a current traffic volume for the particular route (e.g. 1126) the drive-time record (e.g. 1387) is mapped to. This two-bit sub-field (e.g. 1392) is encoded to specify the current traffic volume as follows. A value of one decimal in this sub-field (e.g. 1392) specifies that the current traffic volume is moderate, a value of two decimal specifies that the current traffic volume is heavy, and a value of zero specifies that the particular route is current clear (i.e. the current traffic volume is very light). A value of three decimal in this sub-field (e.g. 1392) specifies that current traffic volume data is unavailable for the particular route (e.g. 1126) the drive-time record (e.g. 1387) is mapped to. The third sub-field in each set (e.g. 1394) is a fixed two bits in size and specifies drive-time and traffic volume trend information for the particular route (e.g. 1126) the drive-time record (e.g. 1387) is mapped to. This two-bit sub-field (e.g. 1394) is encoded to specify this trend information as follows. A value of zero in this sub-field (e.g. 1394) specifies a steady trend (i.e. the drive-time and traffic volume for the particular route are unchanged), a value of one decimal specifies an increasing trend (i.e. the drive-time and traffic volume are trending upward for the route), a value of two decimal specifies a decreasing trend (i.e. the drive-time and traffic volume are trending downward for the route), and a value of three decimal specifies that trend information is unavailable for the particular route.

1.3.4 Traffic Incident Data

FIG. 14 illustrates a diagram of an exemplary embodiment of the format of the traffic incident data payload and FIG. 15 illustrates a diagram of an exemplary embodiment of a prescribed set of possible types of traffic incidents which may be specified within the traffic incident data payload. As depicted in FIG. 14, and referring again to FIG. 4, the traffic incident data payload 405 is a fixed 113 bytes in total size and contains five different data sub-fields 1400-1404 which are identified and formatted as follows. The first sub-field 1400 is a fixed one byte in size and specifies a particular type of traffic incident according to a prescribed set of possible types of traffic incidents. FIG. 15 depicts the possible types of traffic incidents 1500 and their corresponding sub-field 1400 values 1502 that were employed in tested embodiments. It is noted that other embodiments could employ either fewer or more types of incidents 1500, and/or different types of incidents. The second sub-field 1401 is a fixed one byte in size and contains a value which uniquely identifies the incident 1400. The third sub-field 1402 is a fixed three bytes in size and specifies a start time for the incident 1400, where the start time is encoded as the number of minutes since midnight UTC. The fourth sub-field 1403 is a fixed three bytes in size and specifies an estimated end time for the incident 1400, where the estimated end time is encoded as the number of minutes after the start time 1402. The fifth sub-field 1404 is a fixed 105 bytes in size and contains 140 characters, using a six bit encoding per character, which describe the incident 1400.

1.4 Financial Markets Data Broadcasting

Referring again to FIGS. 1 and 4, this section describes the aforementioned financial data category which is stored in the data center 100 and broadcast to each receiver device 110 in the service coverage region 102. The financial data category may employ one or more different types of payloads 404/405. In tested embodiments the financial data category employed a single type of payload 404/405, that being financial markets indicators data. The financial markets indicators data payload type 404 and the data sub-fields (not shown) employed within its payload 405 will now be described in more detail. As described heretofore, the data center 100 is responsible for appropriately pre-formatting the data and placing it into each data field and any related sub-fields.

FIG. 16 illustrates a diagram of an exemplary embodiment of the format of the financial markets indicators data payload. As depicted in FIG. 16, and referring again to FIG. 4, the financial markets indicators data payload 405 is a fixed 113 bytes in total size and contains two different data sub-fields 1600 and 1601 which are identified and formatted as follows. The first sub-field 1600 is a fixed one byte (i.e. eight bits) in size and specifies a current status for the financial markets. In tested embodiments the least significant two bits (not shown) of this sub-field 1600 were used as follows. The least significant bit specifies the current status of the United Status (US) stock market, where a zero in this bit specifies that the US stock market is currently closed, and a one in this bit specifies that it is currently open. The next most significant bit specifies the current status of the Canadian stock market, where a zero in this bit specifies that the Canadian stock market is currently closed, and a one in this bit specifies that it is currently open. Another embodiment is also possible in which only one of the bits in the first sub-field 1600 is used to specify the current status of only one financial market. Yet another embodiment is also possible in which up to all eight of the bits in the first sub-field 1600 are used to specify the current status of up to eight different financial markets. The second sub-field 1601 is a fixed 112 bytes in size and contains the financial markets indicators records data.

FIG. 17 illustrates a diagram of an exemplary embodiment of the format of the financial markets indicators records data sub-field. As depicted in FIG. 17, and referring again to FIG. 16, the financial markets indicators records data sub-field 1601 contains 20 different sub-fields which are organized as four different sets of sub-fields 1700-1703. Each of the four sets of sub-fields 1700-1703 contains five different sub-fields which describe a particular financial market indicator record as follows. The first sub-field in each set (e.g. 1704) is a fixed four bytes in size and specifies a name of a particular market index. More particularly, this sub-field (e.g. 1704) contains a five character index name, using a six bit encoding per character. The second sub-field in each set (e.g. 1706) is a fixed eight bytes in size and specifies a current price for the particular market index specified in the first sub-field (e.g. 1704). The third sub-field in each set (e.g. 1708) is a fixed four bytes in size and specifies a percentage of change from the preceding day's closing price for the particular market index specified in the first sub-field (e.g. 1704). A value of one in the most significant bit of this sub-field (e.g. 1708) specifies that the percentage is negative (i.e. the current price (e.g. 1704) is lower than the preceding day's closing price) and a value of zero specifies that the percentage is positive (i.e. the current price is higher than the preceding day's closing price). The fourth sub-field in each set (e.g. 1710) is a fixed four bytes in size and specifies a high price for the current day for the particular market index specified in the first sub-field (e.g. 1704). More particularly, this sub-field (e.g. 1710) specifies a difference between the high price for the current day and the current price (e.g. 1706) such that the high price is determined by adding this difference to the current price. The fifth sub-field in each set (e.g. 1712) is a fixed four bytes in size and specifies a low price for the current day for the particular market index specified in the first sub-field (e.g. 1704). More particularly, this sub-field (e.g. 1712) specifies a difference between the low price for the current day and the current price (e.g. 1706) such that the low price is determined by subtracting this difference from the current price. A value of 00000000 hex in the first sub-field in a particular set (e.g. 1704) indicates that no additional records are contained in the financial markets indicators records data sub-field 1601. In this case the remainder of this particular set (e.g. the second through fifth sub-fields) would be filled with zeros as would all five sub-fields in any subsequent sets in the financial markets indicators records data sub-field 1601.

1.5 Process for Broadcasting Vehicle Traffic and Financial Markets Data

Figure 18:
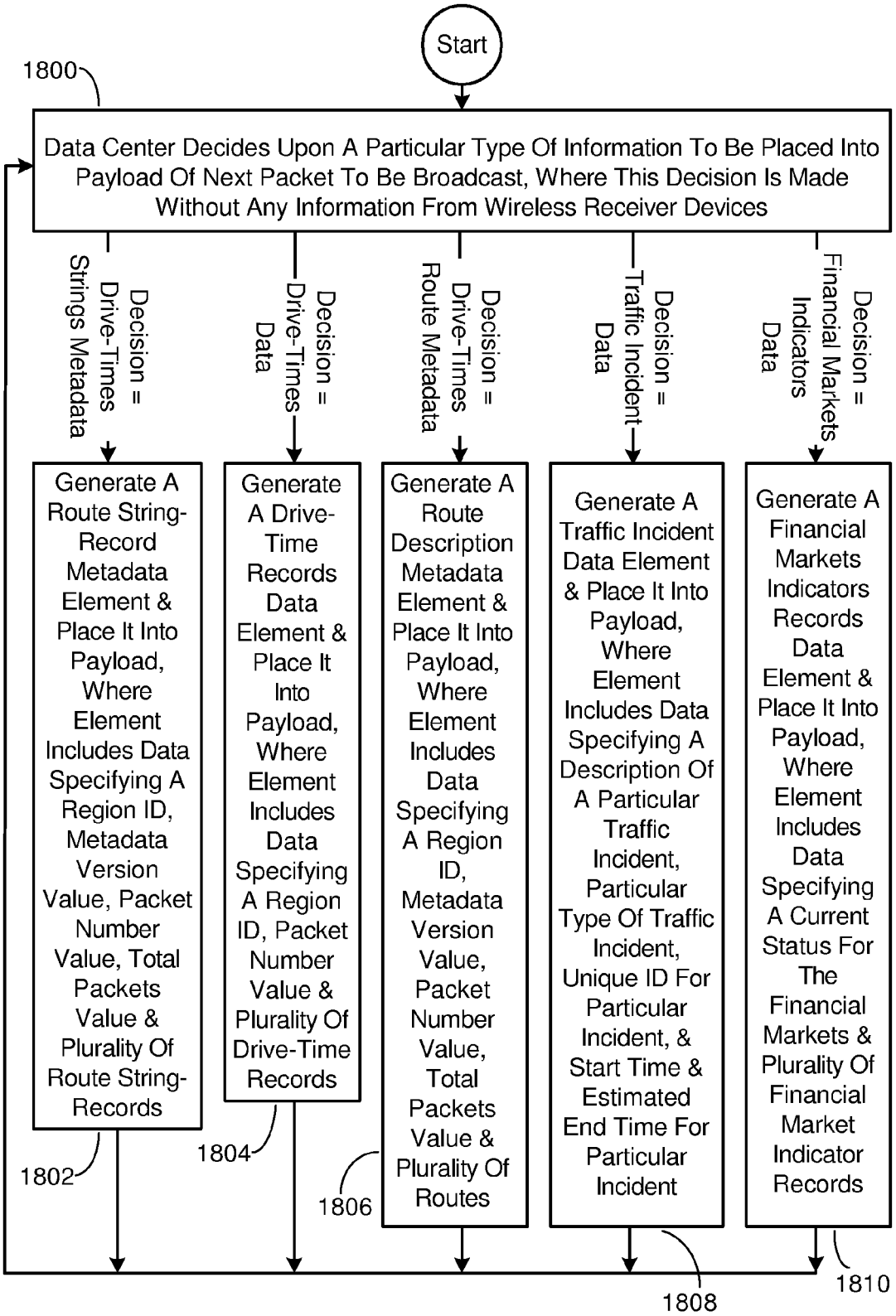
FIG. 18 illustrates an exemplary embodiment of a process for regularly broadcasting packets of vehicle traffic and financial markets data in a push manner.

FIG. 18 illustrates an exemplary embodiment of a computer-implemented process for regularly broadcasting packets of either vehicle traffic or financial markets data over a wireless network in a push manner to one or more wireless receiver devices located within a particular service coverage region. As depicted in FIG. 18, the process starts with the data center deciding upon a particular type of information to be placed into the payload of a next packet to be broadcast, where this decision is made without receiving any information from the receiver devices 1800. If the data center decides that drive-times strings metadata is to be placed into the payload of the next packet to be broadcast, a corresponding route string-record metadata element is generated which includes data specifying a region ID, a metadata version value, a packet number value, a total packets value and a plurality of different route string-records (e.g., 6), and this metadata element is placed into the payload 1802. If the data center decides that drive-times data is to be placed into the payload of the next packet to be broadcast, a corresponding drive-time records data element is generated which includes data specifying a region ID, a packet number value and a plurality of different drive-time records (e.g., 88) each of which is mapped to a particular route, and this data element is placed into the payload 1804. If the data center decides that drive-times route metadata is to be placed into the payload of the next packet to be broadcast, a corresponding route description metadata element is generated which includes data specifying a region ID, a metadata version value, a packet number value, a total packets value and a plurality of different routes (e.g., 27), and this metadata element is placed into the payload 1806. If the data center decides that traffic incident data is to be placed into the payload of the next packet to be broadcast, a corresponding traffic incident data element is generated which includes data specifying a description of a particular traffic incident, a particular type of traffic incident according to a prescribed set of possible types of traffic incidents, a unique ID for the particular traffic incident, and a start time and estimated end time for the particular traffic incident, and this data element is placed into the payload 1808. If the data center decides that financial markets indicators data is to be placed into the payload of the next packet to be broadcast, a corresponding financial markets indicators records data element is generated which includes data specifying a current status for the financial markets and a plurality of different financial market indicator records (e.g., 4), and this data element is placed into the payload 1810. Once the corresponding metadata or data element has been generated and placed into the payload, the process repeats with the data center making a new decision as to a particular type of information to be placed into the payload of a subsequent packet to be broadcast 1800.

2.0 Additional Embodiments

While the data broadcasting technique has been described in detail by specific reference to embodiments thereof, it is understood that variations and modifications thereof may be made without departing from the true spirit and scope of the technique. By way of example but not limitation, although the data fields and sub-fields depicted in FIGS. 4, 8, 9, 10, 11, 12, 13, 14, 16 and 17 are ordered in a particular manner, other embodiments are also possible in which the fields and sub-fields depicted in each of these FIGs. are ordered in a different manner.

It is also noted that any or all of the aforementioned embodiments may be used in any combination desired to form additional hybrid embodiments. Although the technique embodiments have been described in language specific to structural features and/or methodological acts, it is to be understood that the subject matter defined in the appended claims is not necessarily limited to the specific features or acts described heretofore. Rather, the specific features and acts described heretofore are disclosed as example forms of implementing the claims.

Wherefore, what is claimed is:

1. A computer-readable storage medium having stored thereon a vehicle traffic information data structure comprising a payload field containing data representing a particular type of vehicle traffic information, wherein, the particular type of vehicle traffic information comprises one of (i) drive-times strings metadata, or (ii) drive-times data, or (iii) drive-times route metadata, and the data structure and payload field have fixed sizes, and the data structure is generated on a regular basis by a data center and is subsequently broadcast on a regular basis over a wireless network in a push manner to one or more wireless receiver devices located within a particular service coverage region, and the data in the payload field is pre-formatted by the data center and is specific to the particular service coverage region, and wherein whenever the particular type of vehicle traffic information comprises drive-times strings metadata, the payload field comprises, a first sub-field comprising data representing route string-record metadata, a second sub-field comprising data representing a region ID, wherein a change in the region ID informs each receiver device that the route string-record metadata in the first sub-field corresponds to a different service coverage region than the particular service coverage region, a third sub-field comprising data representing a version value, a fourth sub-field comprising data representing a packet number value specifying a sequence number for the vehicle traffic information data structure, and a fifth sub-field comprising data representing a total packets value specifying a total number of vehicle traffic information data structures to be broadcast that will contain said route string-record metadata.

2. The computer-readable storage medium of claim 1, wherein, a most significant two bits of the version value specify a major version value for the route string-record metadata in the first sub-field, a least significant six bits of the version value specify a minor version value for said route string-record metadata, wherein, whenever the minor version value is different from that which was previously broadcast but the major version value is the same as that which was previously broadcast, this informs each receiver device that the route string-record metadata represents additional routes to those which were previously broadcast, and whenever the major version value is different from that which was previously broadcast, this informs each receiver device that any previously broadcast route string-record metadata should be deleted.

3. The computer-readable storage medium of claim 1, wherein the first sub-field of the payload field comprises a plurality of sub-fields organized as pairs of route sub-fields, wherein each pair of route sub-fields specifies a particular route string-record and comprises:

a first route sub-field comprising data representing an ID for the particular route string; and a second route sub-field comprising data comprising a plurality of characters specifying a particular city, landmark or via, using a six bit encoding per character.

4. A computer-implemented process for regularly broadcasting packets of either vehicle traffic or financial markets data over a wireless FM radio sub-carrier network in a push manner to each of one or more wireless receiver devices located within a particular region, comprising, for each packet broadcast:

using a computer to perform the following process actions:

deciding upon a particular type of information to be placed into a payload of a next packet to be broadcast and pre-formatting said information accordingly, wherein, the decision is made and pre-formatting is performed by a data center without receiving any information from the receiver devices, wherein the data center stores a plurality of types of information specific to a particular service coverage region, and the plurality of types of information comprise drive-times strings metadata, drive-times data, drive-times route metadata, traffic incident data and financial markets indicators data;

whenever it is decided that the particular type of information to be placed into said payload comprises drive-times strings metadata, generating a corresponding route string-record metadata element and placing it into said payload, wherein the route string-record metadata element comprises data specifying a region ID, a metadata version value, a packet number value, a total packets value and a plurality of different route string-records;

whenever it is decided that the particular type of information to be placed into said payload comprises drive-times data, generating a corresponding drive-time records data element and placing it into said payload, wherein the drive-time records data element comprises data specifying a region ID, a packet number value and a plurality of different drive-time records each of which is mapped to a particular route;

whenever it is decided that the particular type of information to be placed into said payload comprises drive-times route metadata, generating a corresponding route description metadata element and placing it into said payload, wherein the route description metadata element comprises data specifying a region ID, a metadata version value, a packet number value, a total packets value and a plurality of different routes;

whenever it is decided that the particular type of information to be placed into said payload comprises traffic incident data, generating a corresponding traffic incident data element and placing it into said payload, wherein the traffic incident data element comprises data specifying a description of a particular traffic incident, a particular type of traffic incident according to a prescribed set of possible types of traffic incidents, a unique ID for the particular traffic incident, and a start time and estimated end time for the particular traffic incident; and whenever it is decided that the particular type of information to be placed into said payload comprises financial markets indicators data, generating a corresponding financial markets indicators records data element and placing it into said payload, wherein the financial markets indicators records data element comprises data specifying a current status for the financial markets and a plurality of different financial market indicator records.

5. The process of claim 4, wherein said financial markets indicators records data element is represented by a field in the payload and comprises:

a first sub-field comprising data representing financial markets indicators records; and a second sub-field comprising data representing a current status for the financial markets, wherein each bit in the second sub-field represents a different financial market, a zero in a particular bit in the second sub-field specifies that the financial market is currently closed, and a one in the particular bit specifies that the financial market is currently open.

6. The process of claim 5, wherein the first sub-field comprises a plurality of sub-fields organized as sets of records sub-fields, wherein each set of records sub-fields comprises data representing a particular financial market indicator record and five sub-fields comprising:

a first records sub-field comprising data representing a name of a particular market index, wherein said name comprises a plurality of characters using a six bit encoding per character;

a second records sub-field comprising data representing a current price for the particular market index;

a third records sub-field comprising data representing a percentage of change from the preceding day's closing price for the particular market index;

a fourth records sub-field comprising data representing a high price for the current day for the particular market index; and a fifth records sub-field comprising data representing a low price for the current day for the particular market index.

7. The process of claim 6, wherein, the data in the third records sub-field comprises a value of one in a most significant bit whenever the current price is lower than the preceding day's closing price, and a value of zero in said bit whenever the current price is higher than the preceding day's closing price, the data in the fourth records sub-field represents a difference between the high price for the current day and the current price, wherein the high price for the current day is determined by adding said difference to the current price, and the data in the fifth records sub-field represents a difference between the low price for the current day and the current price, wherein the low price for the current day is determined by subtracting said difference from the current price.

8. The process of claim 4, wherein said traffic incident data element is represented by a field in the payload and comprises:

a first sub-field comprising data representing a description of a particular traffic incident;

a second sub-field comprising data specifying a particular type of traffic incident according to a prescribed set of possible types of traffic incidents;

a third sub-field comprising data representing a unique ID for the particular traffic incident;

a fourth sub-field comprising data representing a start time for the particular traffic incident; and a fifth sub-field comprising data representing an estimated end time for the particular traffic incident.

9. The process of claim 8, wherein, the data in the fourth sub-field comprises the number of minutes since midnight using the universal time code, the data in the fifth sub-field comprises the number of minutes after the start time, and the data in the first sub-field comprises a plurality of characters which describe the particular traffic incident, using a six bit encoding per character.

10. A computer-readable storage medium having stored thereon a vehicle traffic information data structure comprising a payload field containing data representing a particular type of vehicle traffic information, wherein, the particular type of vehicle traffic information comprises one of (i) drive-times strings metadata, or (ii) drive-times data, or (iii) drive-times route metadata, and the data structure and payload field have fixed sizes, and the data structure is generated on a regular basis by a data center and is subsequently broadcast on a regular basis over a wireless network in a push manner to one or more wireless receiver devices located within a particular service coverage region, and the data in the payload field is pre-formatted by the data center and is specific to the particular service coverage region, and wherein whenever the particular type of vehicle traffic information comprises drive-times data, the payload field comprises, a first sub-field comprising data representing drive-time records, a second sub-field comprising data representing a region ID, wherein a change in the region ID informs each receiver device that the drive-time records in the first sub-field correspond to a different service coverage region than the particular service coverage region, and a third sub-field comprising data representing a packet number value, wherein, whenever a most significant bit of the packet number value is set to one, this indicates to each receiver device that the vehicle traffic information data structure is the first in a sequence of said data structures to be subsequently broadcast, and a least significant seven bits of the packet number value specify the total number of said data structures in the sequence that will be broadcast, and whenever the most significant bit of the packet number value is set to zero, the least significant seven bits of the packet number value specify a sequence number for the vehicle traffic information data structure.

11. The computer-readable storage medium of claim 10, wherein the first sub-field of the payload field comprises a plurality of sub-fields organized as sets of records sub-fields, wherein each set of records sub-fields comprises data representing a particular drive-time record which is mapped to a particular route and three sub-fields comprising:

a first records sub-field comprising data representing a current drive-time for the particular route;

a second records sub-field comprising data representing a current traffic volume for the particular route; and a third records sub-field comprising data representing drive-time and traffic volume trend information for the particular route.

12. The computer-readable storage medium of claim 11, wherein, a particular data value in the first records sub-field specifies that no additional drive-time records are available for the particular route, the data in the second records sub-field is encoded such that a value of one decimal in said sub-field specifies that the current traffic volume is moderate, a value of two decimal specifies that the current traffic volume is heavy, a value of zero specifies that the particular route is currently clear, and a value of three decimal specifies that current traffic volume traffic volume data is unavailable for the particular route, and the data in the third records sub-field is encoded such that a value of zero in said sub-field specifies that the drive-time and traffic volume are unchanged, a value of one decimal specifies that the drive-time and traffic volume are trending upward, a value of two decimal specifies that the drive-time and traffic volume are trending downward, and a value of three decimal specifies that drive-time and traffic volume trend information is unavailable for the particular route.

13. A computer-readable storage medium having stored thereon a vehicle traffic information data structure comprising a payload field containing data representing a particular type of vehicle traffic information, wherein, the particular type of vehicle traffic information comprises one of (i) drive-times strings metadata, or (ii) drive-times data, or (iii) drive-times route metadata, and the data structure and payload field have fixed sizes, and the data structure is generated on a regular basis by a data center and is subsequently broadcast on a regular basis over a wireless network in a push manner to one or more wireless receiver devices located within a particular service coverage region, and the data in the payload field is pre-formatted by the data center and is specific to the particular service coverage region, and wherein whenever the particular type of vehicle traffic information comprises drive-times route metadata, the payload field comprises, a first sub-field comprising data representing route description metadata, a second sub-field comprising data representing a region ID, wherein a change in the region ID informs each receiver device that the route description metadata in the first sub-field corresponds to a different service coverage region than the particular service coverage region, a third sub-field comprising data representing a version value, wherein a most significant two bits of the version value specify a major version value for the route description metadata in the first sub-field, and a least significant six bits of the version value specify a minor version value for said route description metadata, a fourth sub-field comprising data representing a packet number value specifying a sequence number for the vehicle traffic information data structure, and a fifth sub-field comprising data representing a total packets value specifying a total number of vehicle traffic information data structures to be broadcast that will contain said route description metadata.

14. The computer-readable storage medium of claim 13, wherein the first sub-field of the payload field comprises a plurality of sub-fields organized as sets of route sub-fields, wherein each set of route sub-fields comprises data representing a particular route and four sub-fields comprising:

a first route sub-field comprising data representing an ID for a particular drive-time record that is mapped to the particular route, wherein said ID specifies a sequence position for the particular drive-time record;

a second route sub-field comprising data representing an origin for the particular route;

a third route sub-field comprising data representing a destination for the particular route; and a fourth route sub-field comprising data representing a pathway for the particular route.

* * * * *

UNITED STATES PATENT AND TRADEMARK OFFICE

CERTIFICATE OF CORRECTION

PATENT NO. : 8,121,777 B2
APPLICATION NO. : 12/043955
DATED : February 21, 2012
INVENTOR(S) : Guerrero et al.

It is certified that error appears in the above-identified patent and that said Letters Patent is hereby corrected as shown below:

In the Specification

In column 13, line 29, delete "United Status" and insert -- United State --, therefor.

In column 13, line 31, delete "a one" and insert -- one --, therefor.

In column 13, line 35, delete "a one" and insert -- one --, therefor.

In the Claims

In column 17, line 32, In Claim 5, delete "a one" and insert -- one --, therefor.

In column 19, line 23, In Claim 12, delete "traffic volume traffic volume" and insert -- traffic volume --, therefor.

Signed and Sealed this
Third Day of February, 2015

Michelle K. Lee

Michelle K. Lee
*Deputy Director of the United States Patent and Trademark Office*